United States Patent [19]

Lundman

[11] Patent Number: 4,796,410

[45] Date of Patent: Jan. 10, 1989

[54] METHOD AND APPARATUS FOR SHIPPING AND STORING PORTABLE AUTOMOBILE RAMPS

[76] Inventor: Philip L. Lundman, 3631 Fredonia-Kohler Dr., Fredonia, Wis. 53021

[21] Appl. No.: 68,230

[22] Filed: Jun. 30, 1987

[51] Int. Cl.[4] ..... B65B 35/56

[52] U.S. Cl. ..... 53/446; 53/447; 53/462; 206/335; 206/386; 206/504

[58] Field of Search ..... 53/447, 446, 462; 206/334, 386, 504, 505, 515, 518; 414/30, 59; 254/88

[56] References Cited

U.S. PATENT DOCUMENTS

| | | | |
|---|---|---|---|
| 1,364,562 | 1/1921 | Laughton | 414/30 |
| 3,208,606 | 9/1965 | Epstein | 206/504 |
| 3,235,070 | 2/1966 | Cutty | 206/333 J |
| 3,347,397 | 10/1967 | Hein | 414/30 |
| 3,917,226 | 11/1975 | Palmer | 254/88 |
| 4,050,403 | 9/1977 | Miller | 254/88 X |
| 4,500,001 | 2/1988 | Daniels | 53/446 X |

*Primary Examiner*—John Sipos

*Attorney, Agent, or Firm*—Michael, Best & Friedrich

[57] ABSTRACT

A container for a portable automobile ramp, the ramp including a platform having opposite ends and an upper surface for supporting an automobile tire, a leg extending downwardly from one end of the platform, and a ramp extending at an incline downwardly from the other end of the platform, and the container comprising a body portion for enclosing the platform of the automobile ramp, the body portion including opposite ends, a leg portion for enclosing the leg of the automobile ramp, the leg portion being integrally connected to the body portion and extending generally perpendicularly from one end of the body portion, and a ramp portion for enclosing the ramp of the automobile ramp, the ramp portion being integrally connected to the body portion and extending obliquely from the opposite end of the body portion.

7 Claims, 4 Drawing Sheets

METHOD AND APPARATUS FOR SHIPPING AND STORING PORTABLE AUTOMOBILE RAMPS

BACKGROUND OF THE INVENTION

The invention relates to portable automobile ramps, i.e., portable ramps for supporting automobile tires. More particularly, the invention relates to methods and apparatus for shipping and storing such ramps, and still more particularly to containers for such ramps and to methods for palletizing such containers.

Portable automobile ramps are often shipped from the manufacturer to the retailer already in their retail packaging. Typically, pairs of ramps are packaged in rectangular boxes, and the boxes are stacked on pallets. In some cases these pallets are shipped in large shipping containers. The cost of shipping such containers depends primarily on the size of the containers, and not on the weight of the contents of the container. Accordingly, the shipping cost per ramp can be minimized by maximizing the number of ramps in a container. This is done by maximizing the number of ramps on a pallet.

SUMMARY OF THE INVENTION

The invention provides a container for portable automobile ramps, and a method for storing or palletizing such containers.

Portable automobile ramps include a platform having opposite ends and an upper surface for supporting an automobile tire, a leg extending downwardly from one end of the platform, and a ramp extending at an incline downwardly from the other end of the platform.

The container of the invention is adapted to house a nested pair of automobile ramps and has a shape conforming to an automobile ramp. More particularly, the container comprises a body portion for enclosing the platform of an automobile ramp, a leg portion for enclosing the leg of an automobile ramp, and a ramp portion for enclosing the ramp of an automobile ramp. The leg portion of the container is integrally connected to the body portion and extends generally perpendicularly from one end of the body portion, and the ramp portion is integrally connected to the body portion and extends obliquely from the opposite end of the body portion.

In the preferred embodiment, each of the portions of the container is generally rectangular in cross section, and the entire container is formed from a single sheet of cardboard. Also, the opposite sides of the container are planar and parallel, so that the container provides a generally horizontal upper surface when it is laid on its side. This permits a plurality of containers to be stacked on their sides on a pallet.

Because the containers conform to the ramp, they can be nested. More particularly, the containers can be laid on their sides with a portion of one container being housed between the leg portion and ramp portion of an adjacent container. For example, the body portion of one container can be housed between the leg portion and ramp portion of an adjacent container. With containers constructed as described above and arranged in nested relationship, more containers can be put in a single layer on a pallet than if the containers were simply rectangular and did not conform to the ramps housed therein.

Other features and advantages of the invention will become apparent to those skilled in the art upon review of the following detailed description, claims, and drawings.

Figure 1:
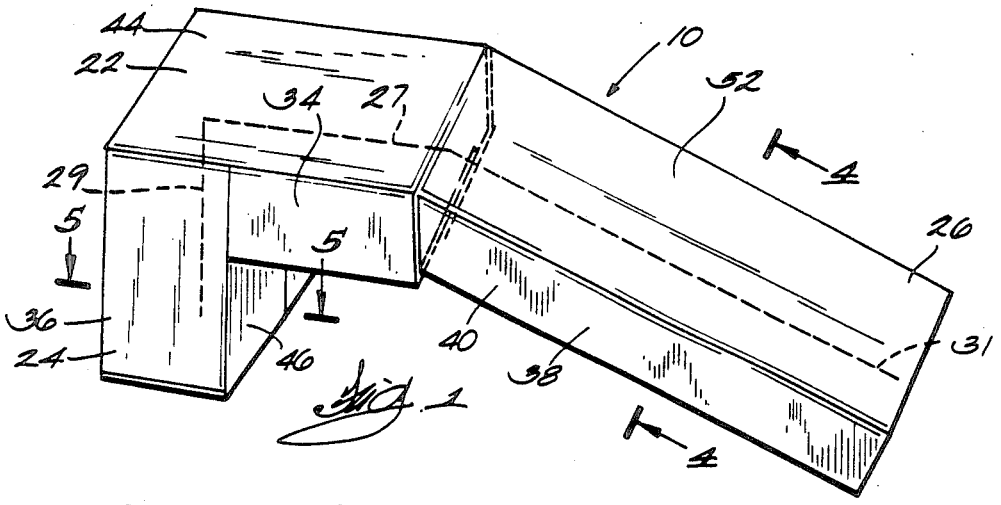
FIG. 1 is a perspective view of a container which embodies the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 13:
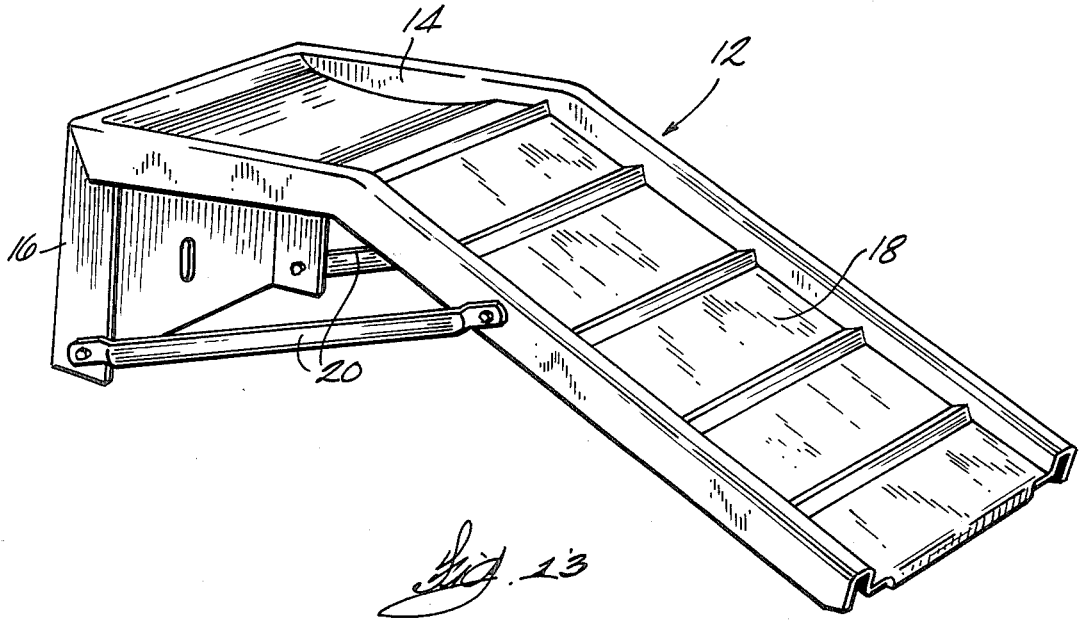
FIG. 13 is a perspective view of an automobile ramp of the type to be housed in the container shown in FIG. 1.

A container 10 embodying the invention is illustrated in the drawings. The container 10 houses at least one automobile ramp 12, and preferably a nested Pair of automobile ramps 12. As shown in FIG. 13, each ramp 12 includes a platform 14 having opposite ends and an upper surface for supporting an automobile tire, a leg 16 extending downwardly from one end of the platform 14, a ramp 18 extending at an incline downwardly from the other end of the platform 14, and a pair of braces 20 extending between the ramp 18 and the leg 16 on opposite sides of the automobile ramp 12.

Figure 3:
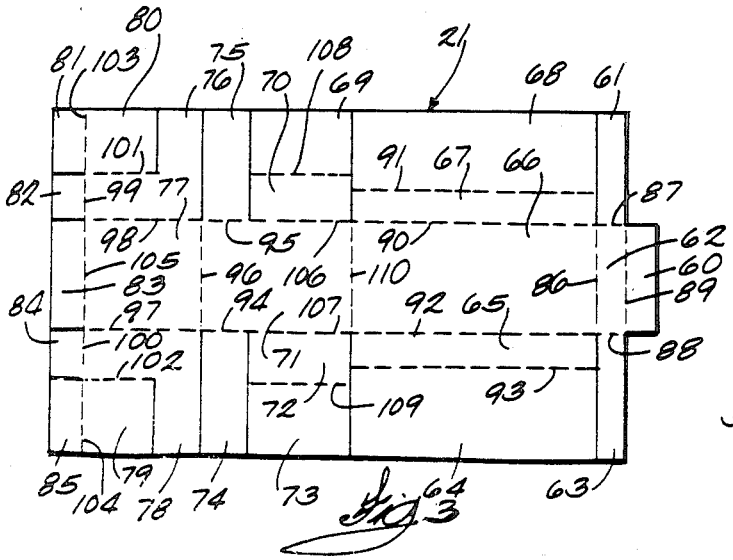
FIG. 3 is a plan view of a sheet of cardboard used to make a container.

The container 10 is made of a single sheet 21 (see FIGS. 3 and 6–12) of generally rigid, foldable material, preferably cardboard. As shown in FIG. 3, the cardboard sheet 21 includes rectangular sections 60–85. Slits are indicated by solid lines, and creases (reference numerals 86-110) are indicated by dotted lines. The manner in which the single sheet 21 of cardboard is folded to form the container 10 is described hereinafter.

As shown in FIG. 1, the container 10 comprises a body portion 22 for enclosing the platform 14 of an automobile ramp 12, or for enclosing the platforms 14 of a nested pair of ramps 12. The container 10 also comprises a leg portion 24 for enclosing the leg 16 of an automobile ramp 12, or for enclosing the legs 16 of a nested pair of ramps 12. The leg portion 24 is integrally connected to the body portion 22 and extends generally perpendicularly from one end of the body portion 22. The container 10 also comprises a ramp portion 26 for enclosing the ramp 18 of an automobile ramp 12, or for enclosing the ramps 18 of a nested pair of ramps 12. Also, the braces 20 of the automobile ramp(s) 12 can be housed in the ramp portion 26 of the container 10. The ramp portion 26 is integrally connected to the body portion 22 and extends obliquely from the opposite end (relative to the leg portion 24) of the body portion 22.

Preferably, the ramp portion 26 intersects the body portion 22 to form an angle of approximately 150°.

Figure 4:
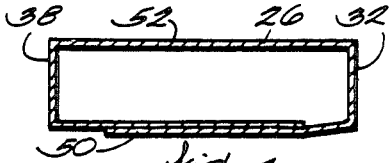
FIG. 4 is a view taken along line 4—4 in FIG. 1.
Figure 5:
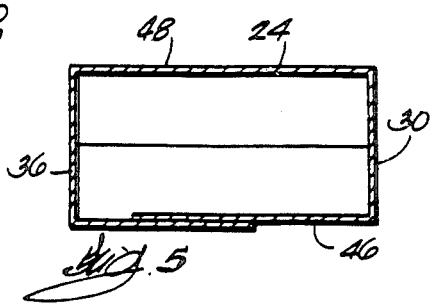
FIG. 5 is a view taken along line 5—5 in FIG. 1.

The body portion 22, the leg portion 24, and the ramp portion 26 are preferably generally rectangular in cross section (see FIGS. 4 and 5) and have respective longitudinal axes 27, 29 and 31 extending in a common plane a vertical plane extending from left to right, through the middle of the container 10, as shown in FIG. 1). The container portions 22, 24 and 26 have (see FIG. 12) generally coplanar first sides 28, 30 and 32, respectively, which are generally parallel to the common plane. The first sides 28, 30 and 32 of the container portions 22, 24 and 26 define a planar first side 33 of the container 10. The container portions 22, 24 and 26 also have (see FIG. 1) generally coplanar second sides 34, 36 and 38, respectively, which are spaced from the first sides 28, 30 and 32, and which are generally parallel to the common plane. The second sides 34, 36 and 38 of the container portions 22, 24 and 26 define a planar second side 40 of the container 10, which second side 40 is parallel to the first side 33 of the container 10.

Also, the body portion 22 includes parallel, spaced-apart inner and outer surfaces 42 and 44, respectively, which extend perpendicular to the sides 28 and 34, the leg portion 24 includes parallel, spaced-apart inner and outer surfaces 46 and 48, respectively, which extend perpendicular to the sides 39 and 36, and the ramp portion 26 includes parallel, spaced-apart inner and outer surfaces 50 and 52, respectively, which extend generally perpendicular to the sides 32 and 38. Furthermore, the leg portion 24 includes an end surface 54, and the ramp portion 26 includes an end surface 56.

Figure 6:
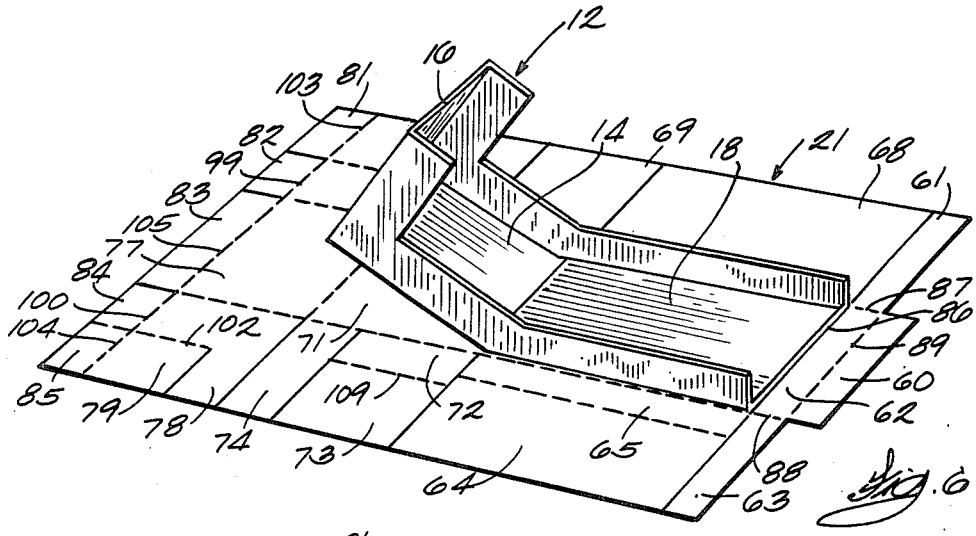
FIGS. 6–12 illustrate an automobile ramp and one way of folding the cardboard sheet shown in FIG. 3 to form a container housing the automobile ramp.
Figure 7:
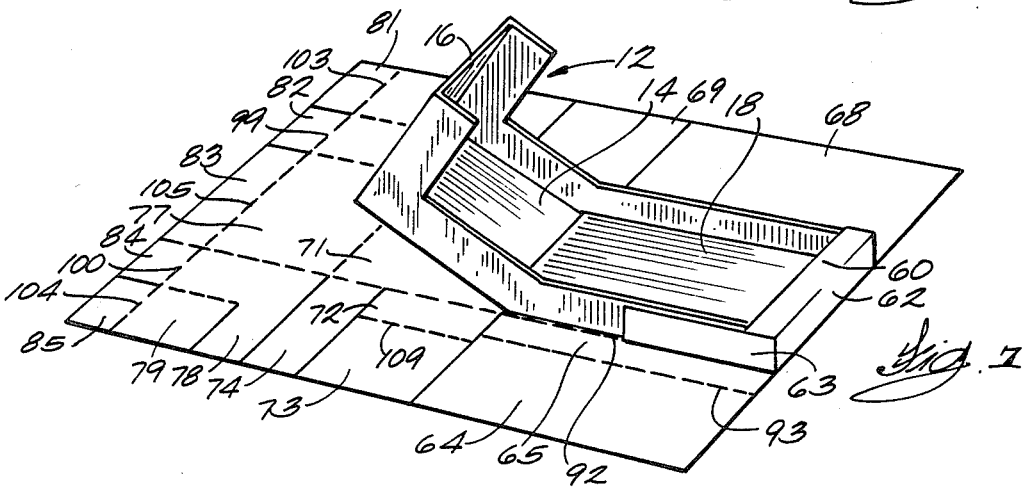
Figure 8:
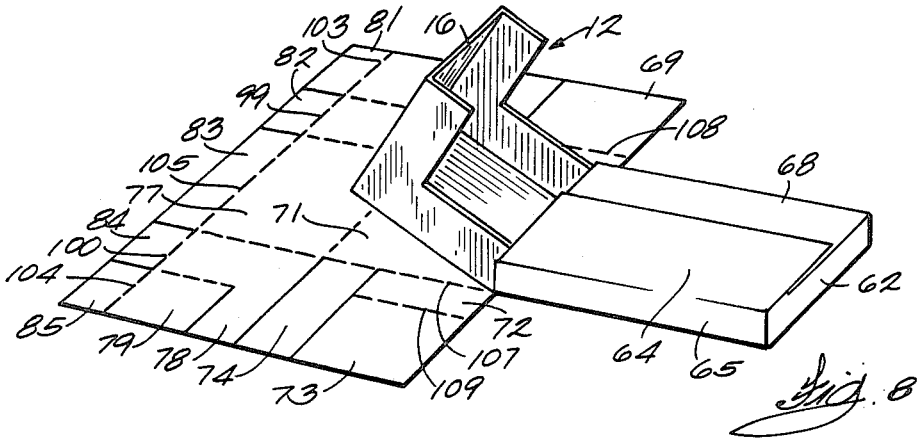

The manner in which the sheet 21 of cardboard is folded to form the container 10 and to house an automobile ramp 12 is illustrated in FIGS. 6–12. First, as shown in FIG. 6, an automobile ramp 12 is placed upside down on the sheet with the upper surface of the ramp 18 aligned with section 66. Next, as shown in FIG. 7, sections 60–63 are folded upwardly along crease 86, sections 61 and 63 are folded rearwardly along creases 87 and 88, respectively, and section 60 is folded rearwardly along crease 89. Next, as shown in FIG. 8, sections 67 and 68 are folded upwardly along crease 90, section 68 is folded over the ramp 18 along crease 91, sections 64 and 65 are folded upwardly along crease 92, and section 64 is folded over the ramp 18 and over section 68 along crease 93. Sections 64 and 68 are then secured to each other by suitable means, such as staples or tape.

Figure 9:
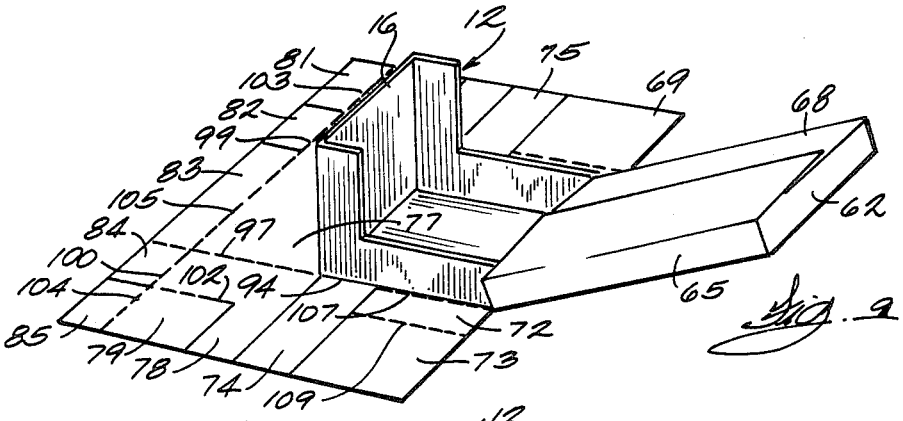
Figure 10:
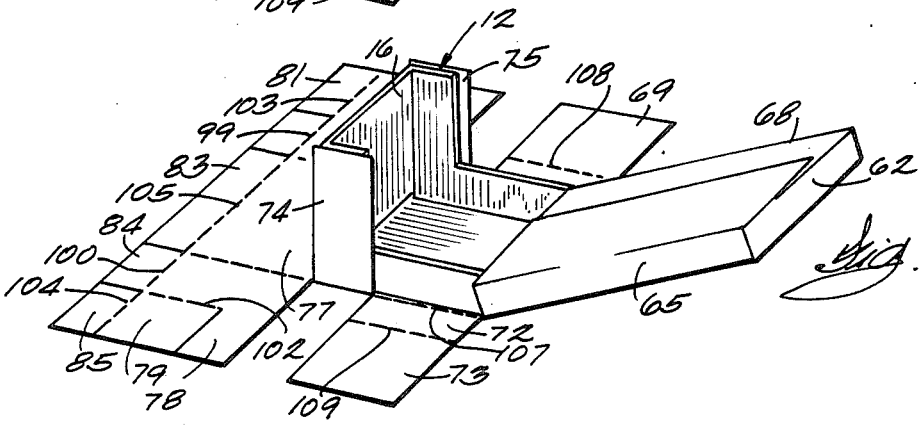
Figure 11:
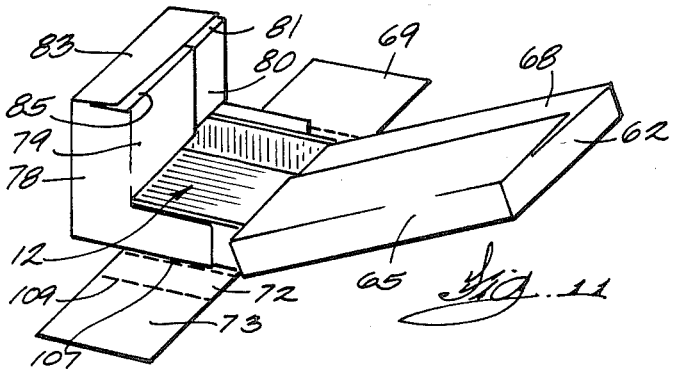

Next, the automobile ramp 12 is tilted counterclockwise as shown in FIG. 9 and the sheet 21 is folded along crease 110 so that the upper surface of the platform 14 rests on section 71. Next, as shown in FIG. 10, sections 74 and 75 are folded upwardly along creases 94 and 95, respectively, on opposite sides of the leg 16. Next, as shown in FIG. 11, sections 76–85 are folded upwardly along crease 96, sections 78, 79, 84 and 85 are folded forwardly along crease 97, and sections 76, 80, 81 and 82 are folded forwardly along crease 98. Next, as also shown in FIG. 11, section 80 is folded over the front of leg 16 along crease 101, and section 79 is folded over section 80 and over the front of the leg 16 along crease 102. Section 79 is secured to section 80 by suitable means. Also, sections 82 and 84 are folded over the end of the leg 16 along creases 99 and 100, respectively, sections 81 and 85 are folded over the end of the leg 16 and over sections 82 and 84 along creases 103 and 104, respectively, and section 83 is folded over sections 81 and 85 along crease 105. Section 83 is secured to sections 81 and 85 by suitable means.

Figure 12:
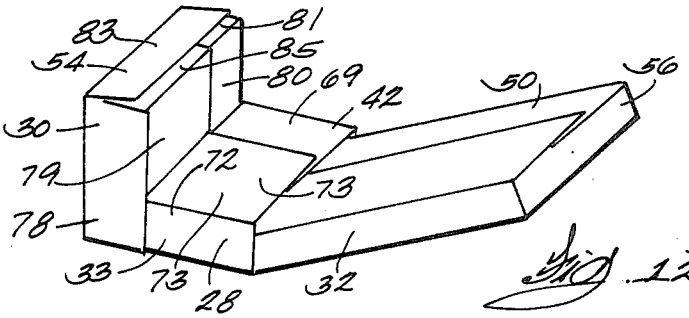

Finally, as shown in FIG. 12, sections 69 and 70 are folded upwardly along crease 106, sections 72 and 73 are folded upwardly along crease 107, section 69 is folded over the platform 14 along crease 108, and section 73 is folded over the platform 14 and over section 69 along crease 109. Section 73 is secured to section 69 by suitable means.

Figure 2:
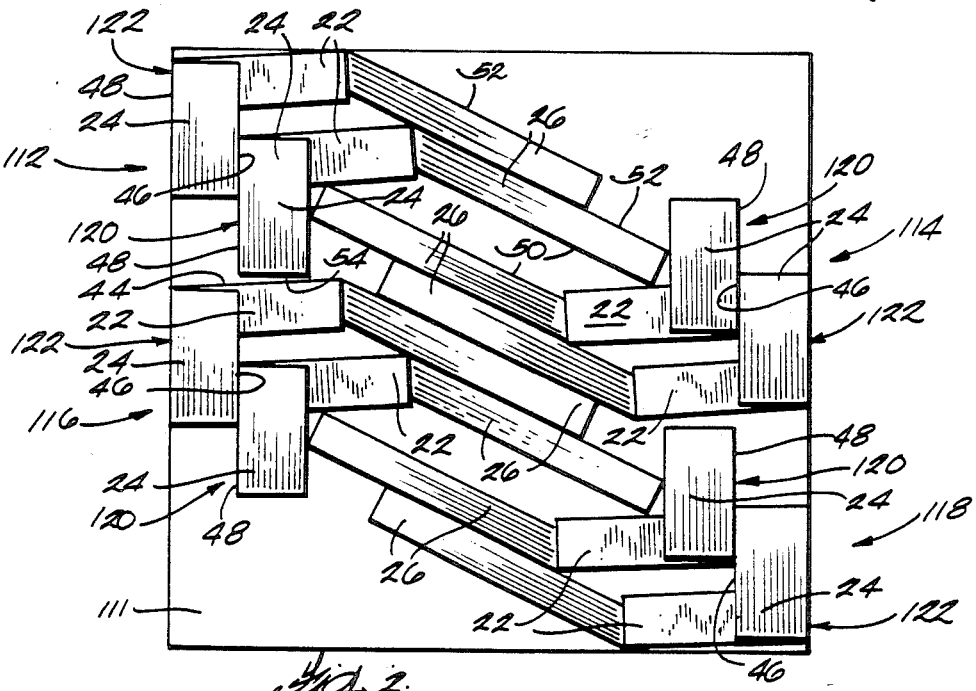
FIG. 2 is a plan view of a layer of containers on a pallet.

A method for palletizing a plurality of containers 10 is illustrated in FIG. 2. More particularly, a single layer of containers 10 on a pallet 111 is shown in FIG. 2. Successive layers can be arranged in the same manner and can be rotated 90°, if desired, to provide stability.

As shown in FIG. 2, eight containers 10 are arranged in a layer. Each container 10 is placed on its first side 33, and the containers 10 are arranged in four pairs 112, 114, 116 and 118, respectively. Each pair is nested and arranged as an inner container 120 and an outer container 122, with the body portion 22 of the inner container 120 housed between the leg portion 24 and ramp portion 26 of the outer container 122, with the outer surface 48 of the leg portion 24 of the inner container 120 in close, face-to-face relationship with the inner surface 46 of the leg portion 24 of the outer container 122, and with the outer surface 52 of the ramp portion 26 of the inner container 120 in close, face-to-face relationship with the inner surface 50 of the ramp portion 26 of the outer container 122.

The first and second pairs 112 and 114 of containers 10 are arranged with the ramp portion 26 of each inner container 120 extending between the leg portion 24 and the ramp portion 26 of the other inner container 120 and with the inner surface 50 of the ramp portion 26 of each inner container 120 generally parallel to and facing the inner surface 50 of the ramp portion 26 of the other inner container 120.

The third pair 116 of containers 10 is oriented in the same direction as the first pair 112, and the second and third pairs 114 and 116 are arranged with the outer surfaces 52 of the ramp portions 26 of the outer containers 122 in close, face-to-face relationship, but with the ramp portions 26 extending in opposite directions. Also, the outer surface 44 of the body portion 22 of the outer container 122 of the third pair 116 is in close, face-to-face relationship with the end surface 54 of the leg portion 24 of the inner container 120 of the first pair 112.

The fourth pair 118 of containers 10 is oriented in the same direction as the second pair 114 and is arranged relative to the third pair 116 in the same manner as the second pair 114 is arranged relative to the first pair 112. Accordingly, the ramp portion 26 of the inner container 120 of the fourth pair 118 extends between the leg portion 24 and the ramp portion 26 of the inner container 120 of the third pair 116, and the inner surfaces 50 of both ramp portions 26 are generally parallel and facing each other. Also, the end surface 54 of the leg portion 24 of the inner container 120 of the fourth pair 118 is in close, face-to-face relationship with the outer surface 44 of the body portion 22 of the outer container 122 of the second pair 114.

FIG. 2 clearly shows that more containers 10 can be placed in a single layer on a pallet with the above-described arrangement than if the containers 10 were simply rectangular.

It is to be understood that the above-described arrangement is only one way in which the containers 10 of the invention can be nested and arranged on a pallet, and that other arrangements are within the scope of the invention.

Various features of the invention are set forth in the following claims.

I claim:

1. A method for storing a plurality of portable automobile ramps, the ramps each including a platform having opposite ends and an upper surface for supporting an automobile tire, a leg extending downwardly from one end of the platform, and a ramp extending at an incline downwardly from the other end of the platform, said method comprising the steps of providing a plurality of substantially identical containers, each of said containers housing at least one of said automobile ramps and having a shape conforming to the at least one ramp housed therein, and each of said containers including a body portion for enclosing the platform of a respective ramp, said body portion including opposite ends, a leg portion for enclosing the leg of said respective ramp, said leg portion being integrally connected to said body portion and extending generally perpendicularly from one end of said body portion, and a ramp portion for enclosing the ramp of said respective ramp, said ramp portion being integrally connected to said body portion and extending obliquely from the opposite end of said body portion, providing a pallet, and arranging said containers in nested relationship on said pallet.

2. A method as set forth in claim 1 wherein said arranging step includes the step of arranging said containers so that at least a portion of one of said containers is housed between the ramp portion and the leg portion of a second of said containers.

3. A method as set forth in claim 1 wherein said first providing step includes the step of providing a pair of said containers, said body portion of each of said containers having generally parallel, opposite first and second sides, said leg portion of each of said containers including generally parallel, opposite first and second sides, and said ramp portion of each of said containers including generally parallel, opposite first and second sides, said first sides of said body portion, said leg portion, and said ramp portion being generally coplanar and defining a first side of said container, and said second sides of said body portion, said leg portion, and said ramp portion being generally coplanar and defining a second side of said container, and wherein said arranging step further includes the steps of placing said first side of each of said containers in contact with said pallet, and arranging said containers as an inner container and an outer container, with the body portion of said inner container nested between the leg portion and the ramp portion of said outer container.

4. A method for storing a plurality of portable automobile ramps, the ramps each including a platform having opposite ends and an upper surface for supporting an automobile tire, a leg extending downwardly from one end of the platform, and a ramp extending at an incline downwardly from the other and of the platform, said method comprising the steps of providing a pair of substantially identical containers, each of said containers housing at least one of the automobile ramps and having a shape conforming to the at least one automobile ramp housed therein, and each of said containers including a body portion for enclosing the platform of a respective automobile ramp, said body portion including opposite ends and generally parallel, opposite first and second sides, a leg portion for enclosing the leg of the respective automobile ramp, said leg portion being integrally connected to said body portion and extending generally perpendicularly from one end of said body portion, said leg portion including generally parallel, opposite first and second sides, and a ramp portion for enclosing the ramp of the respective automobile ramp, said ramp portion being integrally connected to said body portion and extending obliquely from the opposite end of said body portion, said ramp portion including generally parallel, opposite first and second sides, said first sides of said body portion, said leg portion, and said ramp portion being generally coplanar and defining a first side of said container, and said second sides of said body portion, said leg portion, and said ramp portion being generally coplanar and defining a second side of said container, providing a pallet, placing said first side of each of said containers in contact with said pallet, and arranging said containers as an inner container and an outer container, with the body portion of said inner container nested between the leg portion and the ramp portion of said outer container.

5. A method as set forth in claim 4 and further comprising the step of providing a second pair of said containers, wherein said ramp portion of each of said containers has generally parallel, opposite inner and outer surfaces extending generally perpendicular to said first and second sides, and wherein said arranging step further includes the steps of arranging said second pair of containers as an inner container and an outer container, with the body portion of said inner container nested between the leg portion and the ramp portion of said outer container, and arranging said first and second pairs of containers with the outer surfaces of the ramp portions of the outer containers of said first and second pairs in close, face-to-face relationship.

6. A method as set forth in claim 4 wherein said body portion of each of said containers has generally parallel, opposite inner and outer surfaces extending generally perpendicular to said first and second sides and wherein said leg portion of each of said containers has generally parallel, opposite inner and outer surfaces extending generally perpendicular to said first and second sides, and wherein said arranging step further includes the step of arranging said containers with the outer surface of the leg portion of said inner container in close, face-to-face relationship with the inner surface of the leg portion of said outer container, and with the outer surface of the ramp portion of said inner container in close, face-to-face relationship with the inner surface of the ramp portion of said outer container.

7. A method for storing a plurality of portable automobile ramps, the ramps each including a platform having opposite ends and an upper surface for supporting an automobile tire, a leg extending downwardly from one end of the platform, and a ramp extending at an incline downwardly from the other and of the platform, said method comprising the steps of providing a first and second pairs of substantially identical containers, each of said containers housing at least one of the automobile ramps and having a shape conforming to the at least one automobile ramp housed therein, and each of said containers including a body portion for enclosing the platform of a respective automobile ramp, said body portion including opposite ends and generally parallel, opposite first and second sides, a leg portion for enclosing the leg of the respective automobile ramp, said leg portion being integrally connected to said body portion and extending generally perpendicularly from one end of said body portion, said leg portion including generally parallel, opposite first and second sides, and a ramp portion for enclosing the ramp of the respective automobile ramp, said ramp portion being integrally connected to said body portion and extending obliquely from the opposite end of said body portion said ramp portion including generally parallel, opposite first and second sides and generally parallel, opposite inner and outer surfaces extending generally perpendicular to said first and second sides, said first sides of said body portion, said leg portion, and said ramp portion being generally coplanar and defining a first side of said container, and said second sides of said body portion, said leg portion, and said ramp portion being generally coplanar and defining a second side of said container, providing a pallet, placing said first side of each of said containers of said first and second pairs of containers in contact with said pallet, arranging each of said first and second pairs of containers as an inner container and outer container, with the body portion of the inner container nested between the leg portion and the ramp portion of the associated outer container, and arranging said first and second pairs of containers with the ramp portion of each inner container extending between the leg portion and the ramp portion of the other inner container and with the inner surface of the ramp portion of each inner container generally parallel to and facing the inner surface of the ramp portion of the other inner container.

* * * * *